United States Patent [19]

Giebel

[11] Patent Number: 4,602,398

[45] Date of Patent: Jul. 29, 1986

[54] MACHINE FOR LASTING THE HEEL OF A SHOE WITH A WIPER ASSEMBLY

[75] Inventor: Gerhard Giebel, Bad Soden, Fed. Rep. of Germany

[73] Assignee: USM Corporation, Farmington, Conn.

[21] Appl. No.: 748,129

[22] PCT Filed: Feb. 8, 1982

[86] PCT No.: PCT/DE82/00024

§ 371 Date: Oct. 7, 1982

§ 102(e) Date: Oct. 7, 1982

[30] Foreign Application Priority Data

Feb. 9, 1981 [DE] Fed. Rep. of Germany ..... 3104475

[51] Int. Cl.[4] ..... A43D 21/08; A43D 21/00

[52] U.S. Cl. ..... 12/12.5; 12/12; 12/10; 12/14.5

[58] Field of Search ..... 12/7, 8.5, 9, 10, 12, 12/12.5, 14.5

[56] References Cited

U.S. PATENT DOCUMENTS

| | | | |
|---|---|---|---|
| 1,138,584 | 5/1915 | Wentworth . | |
| 2,214,741 | 9/1940 | Chapelle . | |
| 2,293,244 | 8/1942 | Duplessis . | |
| 3,087,176 | 4/1963 | Deschenes | 12/12.5 |
| 3,409,921 | 11/1968 | Stein et al. | 12/12.5 |
| 3,562,828 | 2/1971 | Gower et al. | 12/14.5 |
| 3,579,691 | 5/1971 | Fichtner et al. . | |
| 3,609,785 | 10/1971 | Vornberger | 12/12.5 |
| 3,657,756 | 4/1972 | Schindler et al. | 12/12.5 |
| 3,708,814 | 1/1973 | Barton | 12/12.5 |
| 4,400,839 | 8/1983 | Hartshorn et al. | 12/12.5 |

*Primary Examiner*—Werner H. Schroeder
*Assistant Examiner*—Steven N. Meyers
*Attorney, Agent, or Firm*—Spencer T. Smith

[57] ABSTRACT

A machine for lasting the heel of a shoe comprising a shoe last support including an axially displaceable column having a free end. The support is displaceable from a first retracted position to an advanced position and a shoe last is mounted on the free end of the column for limited rocking movement relative thereto to permit realignment of the shoe last. The column may be elevated from a lower position, and when so elevated, strikes the inner edge portion of the heel band wiper plate which has been displaced to a selected position in interference with an edge portion of the shoe last. Such upward movement of the shoe last will be, accordingly, stopped by the interfering edge portion of the heel band wiper plate and the shoe last will be automatically aligned into uniform engagement therewith. The column is locked at the stopped position and a heel band forcefully engages the stopped and aligned shoe last to maintain the shoe last at that position in that alignment.

2 Claims, 4 Drawing Figures

MACHINE FOR LASTING THE HEEL OF A SHOE WITH A WIPER ASSEMBLY

The invention relates to machines for lasting the heel of a shoe with a wiper assembly.

In such machines the shoe, fitted over a last, is placed on a post which can be swung into the machine bringing the heel region of the last into a position below a shoe support. The post is then extended like a telescope, until the last comes up against the foot support, bringing the shoe on the last to its final position for further processing. Since the heel portion of the last will vary in its curvature, depending on the type of shoe and its size, the end position of the lasting edge of the heel will assume a variety of vertical positions relative to the foot support and wiper assembly. The shoe support accordingly has to be adjusted to properly locate the lasting edge relative to the fixed wiper assembly by adjusting the position of the foot support. This requires that the pressure be released and the post pivoted back to its initial position. Several adjustments often must be made before the correct last location is achieved and this time consuming process is undesirable.

It is accordingly an object of the present invention to provide a machine for lasting the heel of a shoe which will automatically locate the heel of any shoe at its desired location for lasting.

Other objects and advantages of the present invention will become apparent from the following portion of this specification and from the following drawings which illustrate, in accordance with the mandate of the patent statutes, a presently preferred embodiment incorporating the principles of the invention.

Referring to the drawings.

Figure 1:
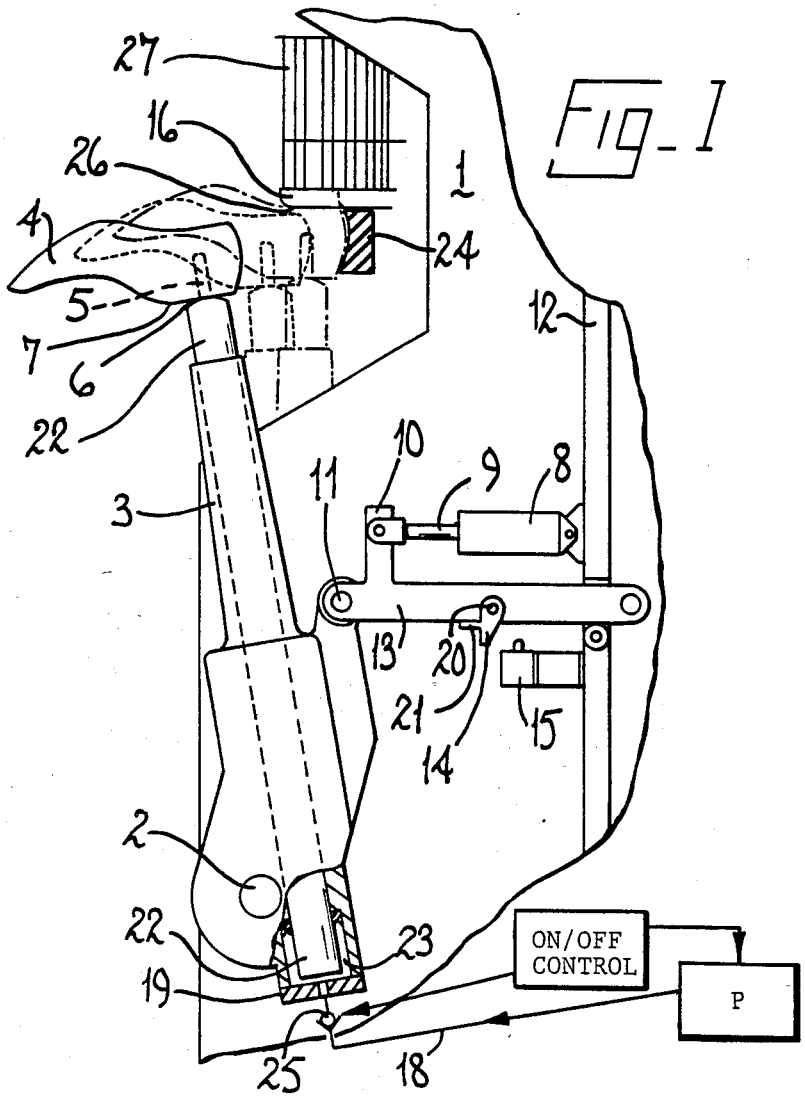
FIG. 1 is an elevational view, partly in section, illustrating the machine for lasting the heel of a shoe made in accordance with the teachings of the present invention.

The lasting machine includes a frame 1 on which is mounted a shaft 2 for pivotally supporting the post 3 for the last, 4. The last 4 is secured on a piston 22 which projects from the post. The last 4 is supported on the post 3 by means of a peg 5 which projects from the piston 22 and is inserted into a corresponding hole in the last 4. To give the last 4 a certain mobility about its longitudinal and transverse axes relative to the piston 22, the end surface 6 of the piston 22 is slightly cambered relative to the comb 7 of the last. Additional mobility is achieved by enlarging the hole in the last relative to the size of the peg.

The post 3 is swingable about its support shaft 2 from its retracted position the continuous line position, to its operative position by the cylinder 8, which extends between an upstanding bracket 10 of a control lever 13 and a wall 12 of the frame 1. One end of the control lever 13 is slidably displaceable within a wall 12 aperture and the other end is pivotally connected via a shaft 11 to the post 13 bracket. The lever 13 has an extension or cam 14 fixed to it which when the post 3 is swung inwards, to its intermediate position (the dotted position) will engage a cam contact 15.

Since a bracket portion 21 of the cam 14 underlies the control lever 13, the cam which is pivotally secured to the control lever 13 via a shaft 20 cannot rotate in the clockwise direction when the cam contact is engaged. The cam contact will accordingly be operated.

A last 4, fitted with an upper will be placed on the peg 5, when the post 3 is in the retracted position shown in FIG. 1. The post 3 can then be swung to the dotted line position in FIG. 1, where the last is just beginning to cross the inner edge of the heel band wiper plates 16.

Figure 3:
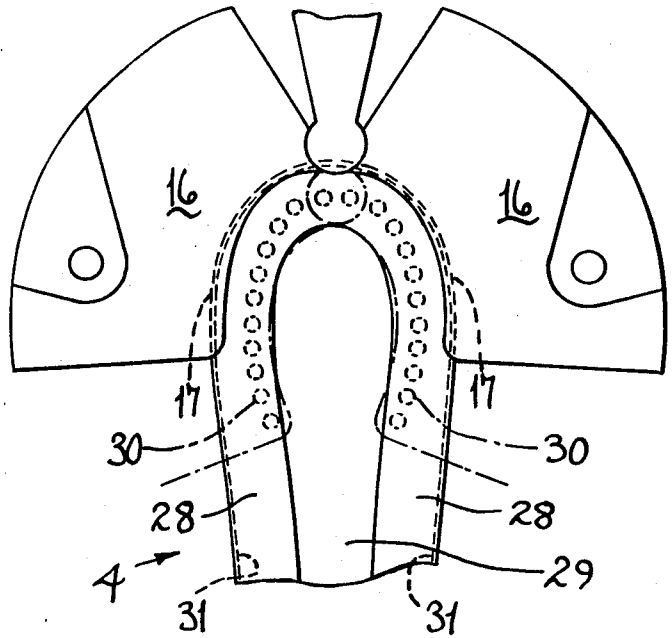
FIG. 3 is a view similar to FIG. 2 illustrating the last when it is at the dot-dash position illustrated in FIG. 2.
Figure 2:
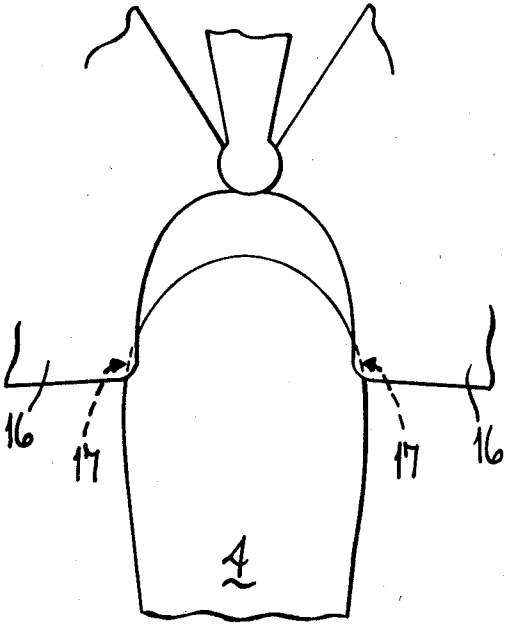
FIG. 2 is a top view of the wiper assembly and the last when the last is at the dotted position illustrated in FIG. 1.

This relative position of the last 4 and heel band wiper plates 16 is shown in a theoretical representation in FIG. 2 (FIG. 3 contains a complete drawing of the heel band wiper plates 16). It will be seen from FIG. 2 that the marginal portion 17 of the last 4, carrying the lasting edge, has barely crossed the edge of the heel band wiper plates 16 and that a spacing 26 exists between the last 4 and the heel band wiper plates 16. In this position of the post 3 the cam 14 strikes the cam contact 15, which is actuated and supplies a suitable signal to the on/off control for the source of pressurized fluid P, whereupon pressurised fluid is supplied through a pipe 18 and a non-return valve 25 to the bottom 19 of the post 3 (The fluid may be displaced by a compressed air cushion to make the pressure rise acting on the piston 22 as even as possible). During the outward movement of the post 3, the cam 14 can pivot past without operating the contact 15. The piston 22 is thus displaced upwardly so that the last 4 which is spaced a selected distance 26 from the heel band wiper plates 16 will approach the heel band wiper plates 16.

During the feed movement from the dotted line position to the dash and dot line position in FIG. 1, pressure builds up progressively in the cavity 23, thereby ensuring that the last is urged against the heel band wiper plates 16 under increasing pressure. The heel band wiper plates 16 will be in an intermediate position, slightly overlying the edge 31 of the insole substantially over its entire periphery, when the last 4 has reached its end position. The last 4 will adjust its position automatically relative to the heel band wiper plates 16 since, as already mentioned, the last 4 can be tilted relative to the end surface 6 of the piston 22, both about the longitudinal axis and about the transverse axis of the last. The heel band 24 is then pressed firmly against the heel of the last 4, thereby immobilising the last in its properly aligned position. The compressed air source P is then switched off and the column 22 will be locked in its position by the non-return valve 25.

In FIG. 3 the last 4 is shown in its end position with the heel band wiper plates 16 in the intermediate position (shown in continuous lines). From this end position of the last 4 and intermediate position of the heel band wiper plates 16 the lasting process takes place, either with the heel band wiper plates being retracted to the fully open starting position followed by shearing in or with the heel band wiper plates shearing in from the intermediate position shown. In either case the heel band wiper plates finally reach the advanced position shown in dash and dot lines, where the lasting edge 28 is placed right over the insole 29 and pressed against it. Tacks may then be fed by the tack driving mechanism 27 (see FIG. 1) through the dash and dot holes 30 into the heel band wiper plates 16.

To complete the cycle, column 22 and post 3 are retracted to their start positions. The piston 22 is lowered by releasing the non-return valve 25. Its release causes pressurised fluid to flow back from the cavity 23 into the pipe 18 (the above-mentioned compressed air source naturally has already been switched off). The flow back of pressurised fluid may be stopped by known means when a desired vertical level of the piston 22 is reached, causing the piston to assume a bottom limit position automatically.

Figure 4:
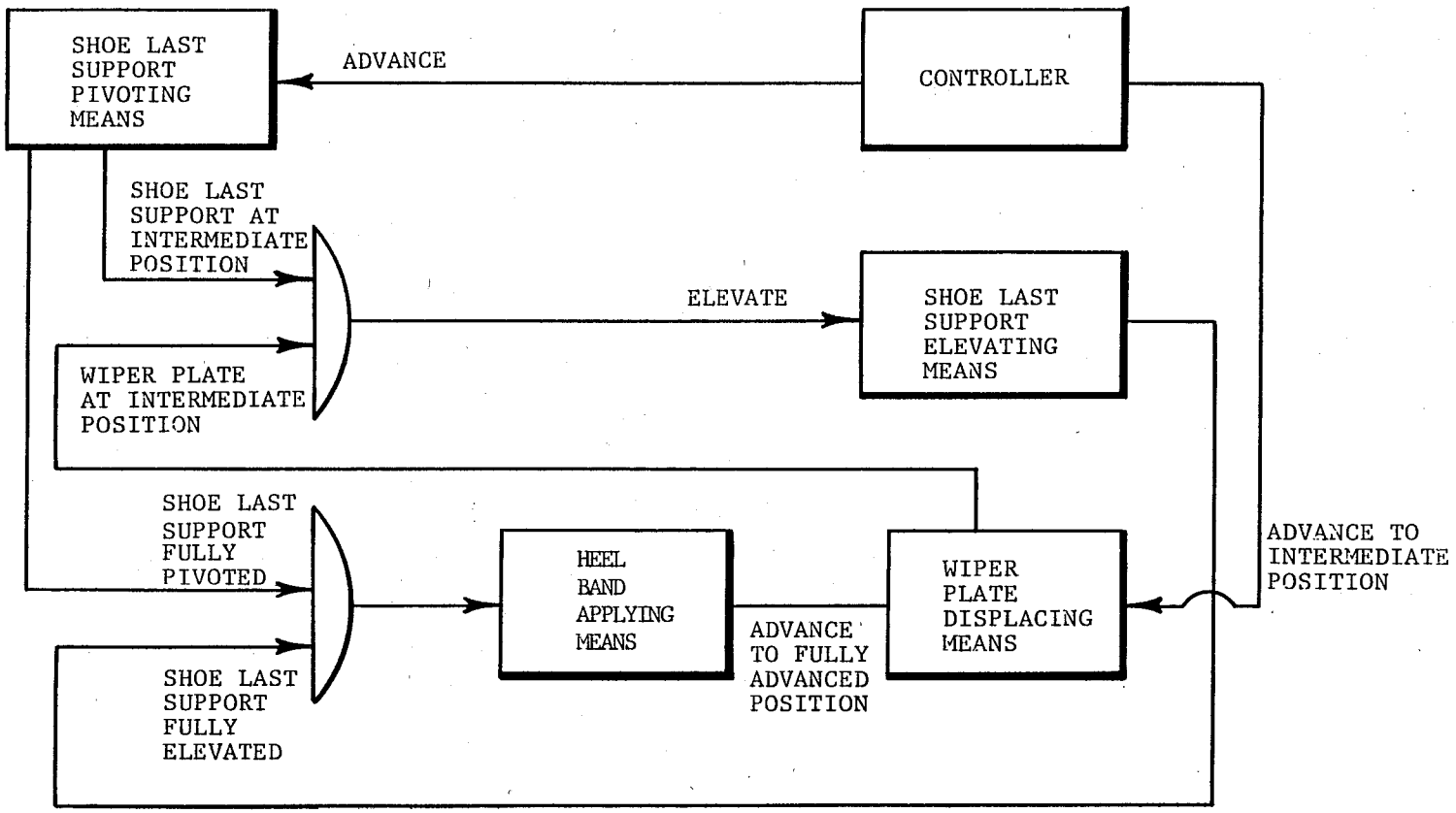
FIG. 4 is a schematic illustration of an operating sequence for the disclosed invention.

The disclosed operation is shown schematically in FIG. 4. As can be seen from this figure the wiper plate is displaceable to an intermediate position and then a fully advanced position. The shoe last support is pivotally displaceable from a retracted position to an advanced position and is additionally axially elevatable. The shoe last support will be fully pivoted and the wiper plate will be advanced to the intermediate position before the shoe last support is axially elevated. The shoe last support must be fully pivoted and elevated before the heel band is applied. After this has been done, the wiper plate will be displaced from its intermediate position to its final position.

I claim:

1. A machine for lasting the heel of a shoe which is supported on a last comprising:

shoe last support means including an axially displaceable column having a free end, means for displacing said support means from a first retracted position to an advanced position, means for mounting the shoe last on said free end of the column for limited rocking movement relative thereto to permit realignment of the shoe last, wiper plate means, means for displacing said wiper plate means to a selected position in inteference with an edge portion of the shoe last prior to said column being elevated with said support means in the advanced position, means for elevating said column from a lower position when said support means is in the advanced position and when said wiper plate means is at said selected interference position whereby such upward movement of the shoe last will be stopped by the interfering edge portion of said wiper 1*a* means and the shoe last will be automatically aligned into uniform engagement therewith, means for locking said column at said stopped position, heel band means adapted to forcefully engage the stopped and aligned shoe last for maintaining the alignment of the shoe last, means for applying said heel band and means for advancing said wiper plate means from said selected interference position to an advanced position after said heel band means has been applied for wiping the shoe last.

2. A machine for lasting the heel of a shoe according to claim 1, wherein said elevating means comprises a source of pressurized fluid and said locking means comprises a selectively operable non-return valve.

* * * * *